United States Patent [19]

Keijiro

[11] Patent Number: 4,889,338

[45] Date of Patent: Dec. 26, 1989

[54] RACKET FRAME

[75] Inventor: Hayashi Keijiro, Takatsuki, Japan

[73] Assignee: Mizuno Corporation, Osaka, Japan

[21] Appl. No.: 134,079

[22] Filed: Dec. 17, 1987

[30] Foreign Application Priority Data

Dec. 29, 1986 [JP] Japan ..... 61-310927

[51] Int. Cl.[4] ..... A63B 49/06

[52] U.S. Cl. ..... 273/73 G; 273/73 R; 428/905

[58] Field of Search ..... 273/73 C, 75, 73 R, 273/73 J, 73 D, 73 G; 63/1.1, DIG. 2; 512/4; 428/905

[56] References Cited

U.S. PATENT DOCUMENTS 2,620,227 12/1952 Iwase et al. ..... 428/905
3,888,416 6/1975 Lin ..... 428/905
4,139,195 2/1979 Dreesen et al. ..... 273/75
4,254,179 3/1981 Carson et al. ..... 428/905
4,413,822 11/1983 Fernandez et al. ..... 273/73 C

*Primary Examiner*—Edward M. Coven
*Assistant Examiner*—William E. Stoll
*Attorney, Agent, or Firm*—Wenderoth, Lind & Ponack

[57] ABSTRACT

Racket frames for playing tennis, badmitton or squash wherein powdered solid perfume, especially microencapsulated powdered solid perfume is arranged between the different parts of a racket frame, for example, in the attachment composed of an elastic part for fixing perfume, a stationary part and a contacting part, inserted in a notched part in the middle of the yoke of the racket frame and the powdered solid perfume emits fragrance from the racket frame with different kinds of perfumes, due to external factors for example, rubbing or pressurizing or the like when players use the racket.

3 Claims, 3 Drawing Sheets

RACKET FRAME

BACKGROUND OF THE INVENTION

Most of the encapsulated solid or powdered perfumery heretofore in use is a powdered solid perfume made from liquid perfume emulsified by gum arabic, dextrin and other several kinds of emulsifiers by spray drying, but the powdered solid perfumes increasingly in use are microencapsulated perfumes used in water solution or in solution of several organic solvents and emit fragrance by rubbing or pressurizing the powdered solid perfumes. However, there was no art heretofore using such perfumes for racket frames for tennis, badminton or squash.

SUMMARY OF THE INVENTION

This invention offers racket frames emitting fragrances when players use the said racket frames.

This invention relates to a racket frame which emits fragrance by the solid perfume arranged in the different components of the said racket frame which are rubbed or pressurized when players use the racket frame of this invention.

It is an object of this invention to provide a racket frame which emits various fragrances when players use said racket frame and so that players may further enjoy tennis, badminton or squash, throughout the game.

DETAILED DESCRIPTION OF THE INVENTION

This invention is directed to a racket frame which emits fragrance from a powdered solid perfume arranged in different parts of the racket frame.

Figure 1:
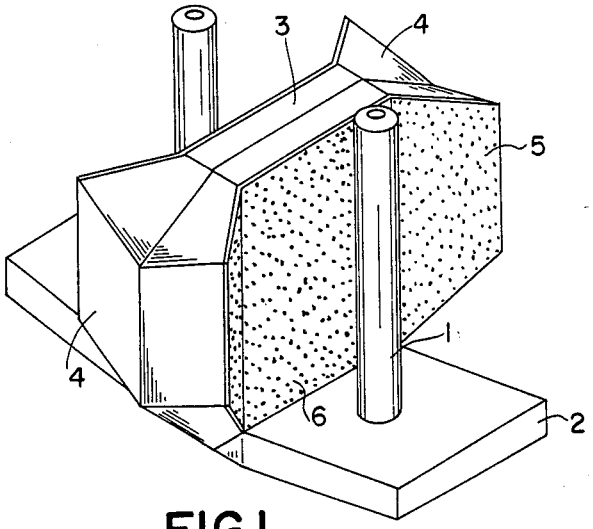
FIG. 1 and FIG. 2 are the perspective views of a perfume dispensing device used with a divided yoke.
Figure 2:
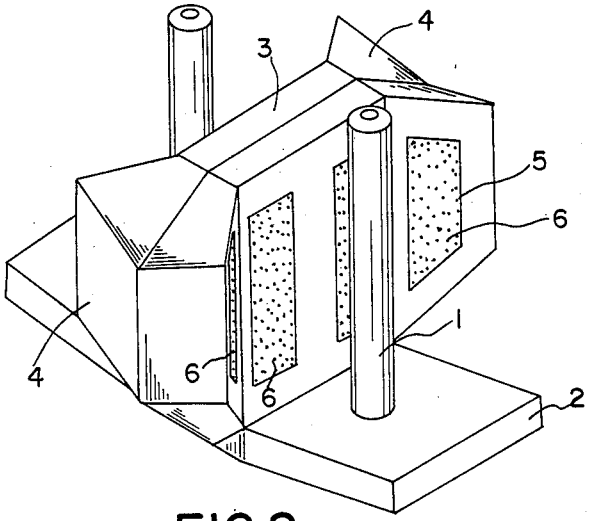

This invention is described as follows based on the accompanying drawings:

FIG. 1 is a perspective view of the attachment. One set of grommets (1), through which strings are passed, are united by a connecting member (2) which is inserted in the middle of divided yoke (7) and standing part (3) is located in nearly the middle of said connecting member (2). Elastic members (4) for affixing perfume are provided adjacent to both sides of said standing part (3) where it contacts contact member (5) of the attachment.

This invention relates to a racket frame in which powdered solid perfume arranged in the different components of racket frame (11) and said powdered solid perfume emits fragrance.

Figure 3:
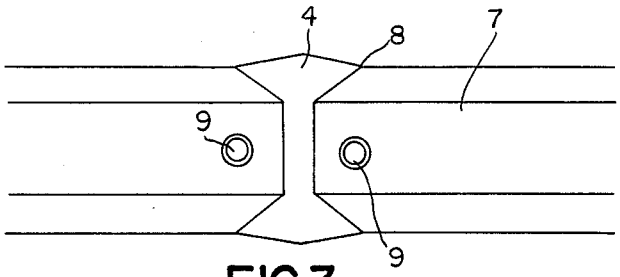
FIG. 3 to FIG. 5 are illustrations showing the embodiment wherein the microencapsulated perfume emits fragrance.
Figure 4:
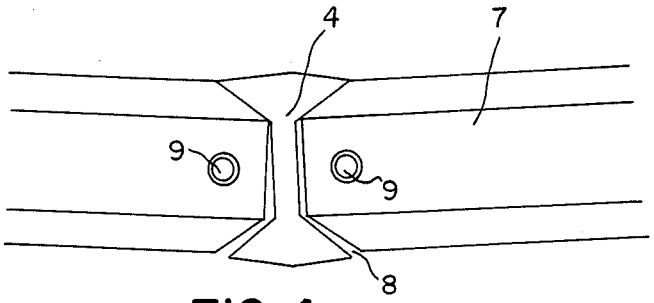
Figure 5:
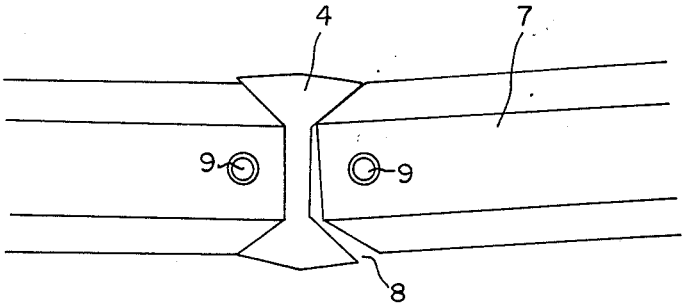
Figure 6:
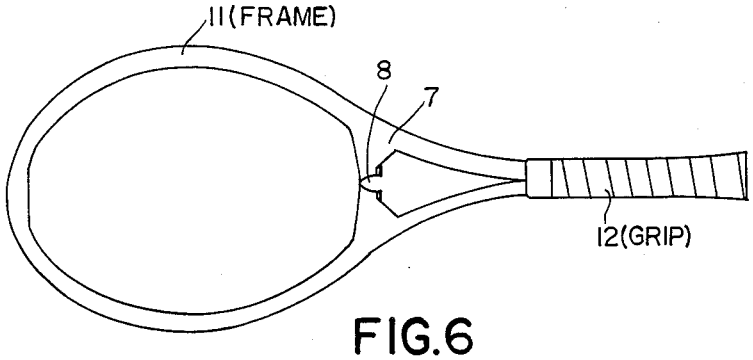
FIG. 6 is a perspective view of the tennis racket of the present invention equipped with a perfume dispensing device with a divided yoke (7), having powdered solid perfume inserted in the notched portion (8), said racket having frame part (11) and grip part (12).
Figure 7:
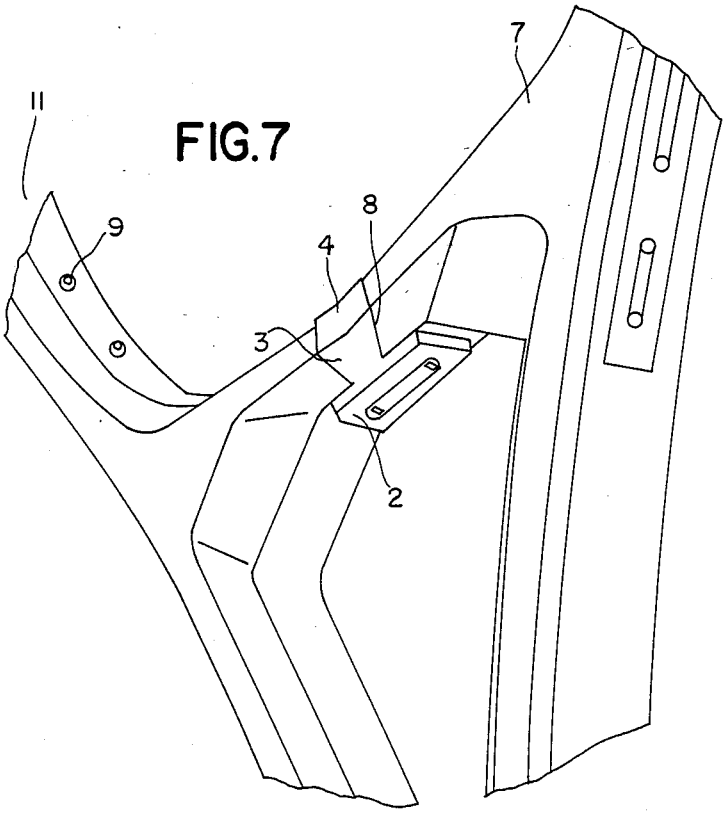
FIG. 7 is an enlarged view of the connecting device with the divided yoke of FIG. 6 which is shown in FIGS. 3 to 5 and (9) is a grommet of the racket.

In the above-described example, as shown in FIG. 3 to FIG. 5, when players hit the ball at the center of hitting zone (sweet spot), the attachment of the present invention is bent toward to the opposite side of hitting surface centering around the notched part and said notched part is enlarged toward the opposite side of hitting surface as shown in FIG. 4 and so the elastic members (4) for fixing the perfume are pressed toward yoke and therefore the yoke is drawn toward the central axis by the pressure of the attachment and strings and is restored to its original location as shown in FIG. 3.

In another case, when the players hit the ball off-center of hitting zone, the yoke of the hitting side is shifted to the opposite side of the hitting surface and elastic member for fixing perfume (4) on the opposite side of the hitting surface of racket frame pushed down as is shown in FIG. 5.

Then the yoke is pulled nearer to the central axis and is returned to its original place as shown in FIG. 3. At this time, the yoke (7) and elastic member (4) of the attachment are rubbed against each other, therefore the powdered solid perfume emits fragrance.

This invention is not limited to the above-described examples.

The different component sections of this invention are the sections between yokes connected to each other and between grommets (9) through which the strings are passed.

Ordinary or microencapsulated perfume is used as powdered solid perfume in this invention, but it is desirable to use microencapsulated perfume from the viewpoint of retaining the fragrance.

In case of tablets, pellets, granules and powders, these are filled in a definite vessel (e.g. mesh type vessel).

The perfumes used in the present invention may be of animal, plant, natural, synthetic and hybrid origin e.g. fruit, for example, strawberry or lemon or cosmetic perfumes.

Since the present invention, as described above, is a racket frame in which powdered solid perfume is arranged between different components, the powdered solid perfume itself does not independently emit fragrance and it requires external factors, for example, contact with water, organic solvent or rubbing or pressurizing to emit fragrances, i.e. only when the players use said racket frame, and this invention provides excellent retention of perfume.

What is claimed is:

1. A racket frame comprising a divided yoke portion, said yoke portion having a notched portion therein, said notched portion having an elastic insert therein in contact with said yoke portion, said elastic insert having a microencapsulated perfume thereon, and wherein said yoke portion and said elastic insert are so arranged that perfume is released when said elastic insert is subjected to pressure from said yoke portion.

2. The racket frame according to claim 1 wherein said notched portion is inserted substantially in the middle of the divided portion of said racket.

3. The racket frame according to claim 2 wherein said elastic insert is attached to said racket frame via a connecting member disposed substantially tangential to the circumference of said racket frame and said connecting member having grommets for attachment to said frame on both sides of said elastic insert.

* * * * *